United States Patent [19]

Goldstone

[11] Patent Number: 4,813,521

[45] Date of Patent: Mar. 21, 1989

[54] STACKING HAND LUGGAGE

[76] Inventor: Robert J. Goldstone, 4131 NW 101 Dr., Coral Springs, Fla. 33065

[21] Appl. No.: 131,037

[22] Filed: Dec. 10, 1987

[51] Int. Cl.[4] ..... A45C 5/14; A45C 13/00; A45C 13/10

[52] U.S. Cl. ..... 190/120; 190/18 A; 190/108; 312/244

[58] Field of Search ..... 190/3, 6, 15 R, 13 B, 190/18 A, 33, 100, 107, 108, 111, 114, 120, 11, 13 R, 12 R; 312/107, 244, 341 R

[56] References Cited

U.S. PATENT DOCUMENTS

| | | | |
|---|---|---|---|
| 273,398 | 3/1883 | Scheuer | 190/111 |
| 325,555 | 9/1885 | Meuer et al. | 190/15 R |
| 825,642 | 7/1906 | Enright | 190/15 R |
| 953,715 | 4/1910 | Sachs | 190/33 |
| 953,815 | 4/1910 | Boyd | 190/33 |
| 1,143,711 | 6/1915 | Kennedy | 190/114 |
| 1,365,098 | 1/1921 | Hamlin | 190/13 B |
| 1,495,046 | 5/1924 | Spiegel | 190/111 |
| 1,611,034 | 12/1926 | Holm | 190/15 R |
| 2,055,657 | 9/1936 | Gordon | 190/114 X |
| 2,565,969 | 8/1951 | Judson | 190/15 R |
| 2,714,433 | 8/1955 | Wilson | 190/6 |
| 3,828,899 | 8/1974 | Scott | 190/120 |
| 3,891,230 | 6/1975 | Mayer | 190/18 A X |
| 3,974,898 | 8/1976 | Tullis et al. | 190/108 X |
| 3,987,875 | 10/1976 | Szabo | 190/18 A |
| 4,066,155 | 1/1978 | Buchek | 190/3 |
| 4,118,048 | 10/1978 | Spranger et al. | 190/18 A X |
| 4,139,084 | 2/1979 | Linke | 190/111 X |
| 4,202,586 | 5/1980 | Oplinger | 312/107 |
| 4,389,078 | 6/1983 | Strett | 312/107 X |
| 4,693,345 | 9/1987 | Mittelmann | 190/18 A X |

*Primary Examiner*—Sue A. Weaver
*Attorney, Agent, or Firm*—John H. Faro

[57] ABSTRACT

Hand luggage comprising a substantially rectangular shell including two opposed major walls and an open end therebetween. A single rectangular drawer is slidably mounted in the shell. The drawer includes a front wall having a marginal flange that overlaps and completely closes the open end when the drawer is slid to its closed position. A carrying handle is attached outside the luggage to the end wall. Also, there is a means for detachably latching the shell to the drawer when the drawer is in its closed position.

3 Claims, 2 Drawing Sheets

STACKING HAND LUGGAGE

BACKGROUND OF THE INVENTION

1. Field of the Invention

This invention relates to a novel hand luggage and particularly to a novel hand luggage that can be stacked upon luggage of the same design; and, when such luggage is stacked, all of the interiors thereof can be accessed.

2. Description of the Prior Art

Hand luggage is available in many forms and designs including valises, satchels, carry bags, suitcases etc. Some prior hand luggage are stiff rectangular containers that can be placed on their major (large) sides, one upon the other, into a stack. But, because of their designs, the interiors of the prior hand luggage cannot be accessed when they are in a stack.

However, in a small hotel room or ship's cabin, where space is limited, it is desirable to stack hand luggage to conserve space. Also, in such situations, it is desirable, and frequently necessary, to avoid unpacking and repacking the contents of hand luggage and, instead, use the luggage as a temporary storage place for clothing and personal items.

Some prior hand luggages; such as are described in U.S. Pat. Nos. 1,143,711 to H. L. Kennedy and 2,055,657 to J. H. Gordon; have top-openings lids which permit better access to the interiors of the luggages. However, these prior luggages are not stackable, and when other luggages are piled upon them, the interiors thereof are not accessible.

Other prior hand luggages; such as are described in U.S. Pat. Nos. 1,495,046 to M. J. Spiegel and 4,139,084 to N. H. J. Linke, and also British Pat. No. 585,845 to Salgo-Sayer Limited et al; are rectangular containers having larger main lids and at least one smaller auxiliary lid in the main lid. French Pat. No. 732,690 to M. B. Petit describes similar hand luggage with doors in the handled minor front wall of a rectangular container, and states that the doors can be replaced with drawers. These prior luggages are stackable, but the auxiliary lids and doors provide access to only limited parts of the interior of these prior luggages and, in most designs, do not permit access to the contents of the luggage when the luggage is stacked with other luggage.

OBJECTS OF THE INVENTION

It is an object of this invention to provide a novel hand luggage.

A further object is to provide a novel hand luggage that is stackable and whose interior is fully accessible when it is stacked with other luggage.

Another object is to provide a novel stackable hand luggage that is light in weight, economical to manufacture, and whose interior is fully accessible when it is stacked with other luggage.

Still another object is to provide stackable luggage which can interlock with other luggage of similar design to produce a more stable stack.

SUMMARY OF THE INVENTION

The novel hand luggage comprises a substantially rectangular shell including two major walls and an open end therebetween. A single rectangular drawer is slidably mounted in the shell in such manner that it can be slid in the open end of the shell. The drawer includes a front wall having a marginal flange that overlaps, and preferably includes a portion that extends around, the shell, so as to completely close the open end of the shell when the drawer is slid to its closed position. A carrying handle is attached to the front wall, and there are means for detachably latching the shell to the drawer when the drawer is in the closed position.

One of the major walls of the shell, preferably the bottom wall, may have an array of depressions therein, and the other major wall may have a matching array of extensions opposite the depressions. The said depressions and extensions are adapted for mating with similar ones in other luggage in a stack of luggage. The luggage may also include means inside the drawer for holding down items stored therein, and casters attached to the outside back wall of the shell of rolling the luggage on a pavement.

By providing a single drawer in a rectangular shell, the novel luggage can be stacked with other rectangular luggage, especially luggage of similar design. The entire interior of the novel luggage is fully and conveniently accessible while it is stacked. Thus, the novel luggage conserves space, and can be used as a dresser drawer, thereby obviating the need to unpack and repack the contents of the luggage. When the novel luggage needs to be transported, it is only necessary to close the drawer, latch the shell to the drawer and carry the luggage by its handle.

DETAILED DESCRIPTION OF THE INVENTION INCLUDING PREFERRED EMBODIMENTS

Figure 1:
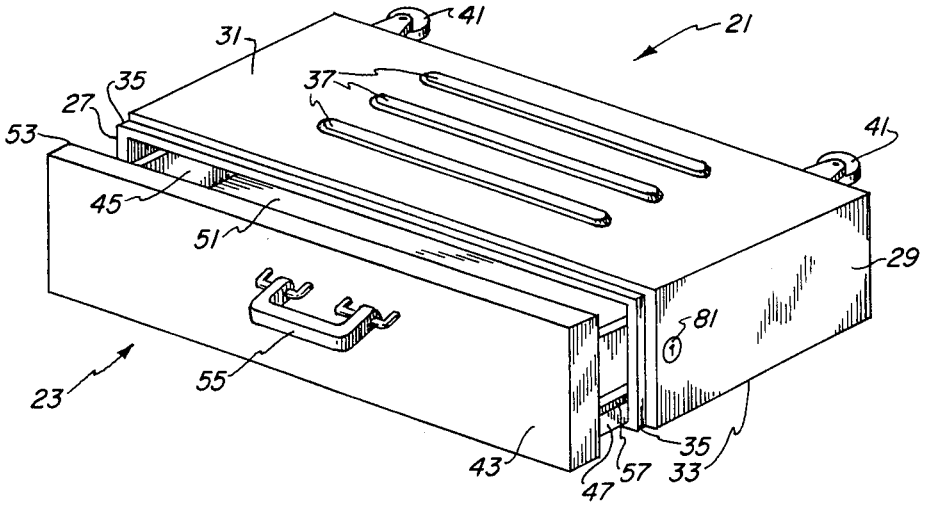
FIG. 1 is a perspective view of a preferred embodiment of the novel hand luggage of the invention.
Figure 2:
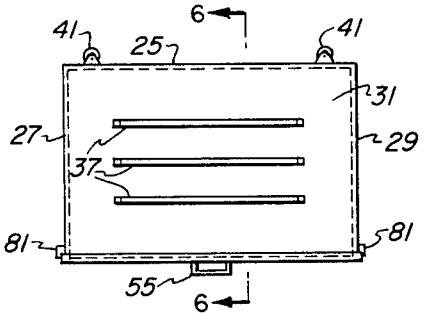
FIGS. 2, 3, 4 and 5 and respectively, simplified top, front, bottom and side views of the novel luggage shown in FIG. 1.

The following description of some of the preferred embodiments of the concepts of this invention is made in reference to the accompanying figures. Where an individual structural element is depicted in more than one figure, it is assigned a common reference numeral for simplification of identification and understanding.

The preferred embodiment shown in FIGS. 1 to 5 include a rectangular shell (21) and a drawer (23) slidably mounted in the shell (21). The shell (21) includes a back wall (25), a right side wall (27), a left side wall (29), a top wall (31) and a bottom wall (33), preferably molded as a single piece of a hard, durable, light-weight plastic/fiberglass material, although the shell could be made of several attached parts. The front end of the shell (21) is open and the margins adjacent the open end of the side, top and bottom walls (27), (29), (31) and (33) have a peripheral recess (35) therein.

Figure 6:
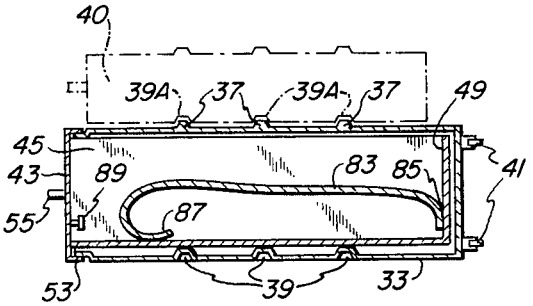
FIG. 6 is a simplified sectional view of the novel luggage viewed along section line 6—6 of FIG. 2.
Figure 4:
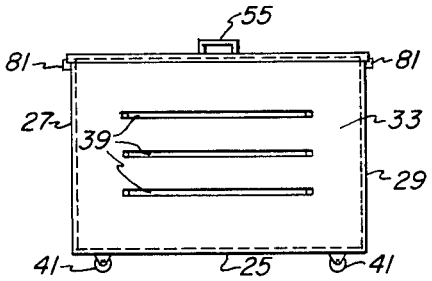

The top wall (31) has three, although it can be more or less than three, spaced extensions (37) that rise above the outer surface thereof and have flat tops and steep angled sides like mesas. The bottom wall (33) has three spaced depressions (39) in the outer surface thereof, which depressions are opposite the extensions (37) and are designed to mate with similar extensions in other luggage. The top and bottom walls (31) and (33) are considered the major walls of the shell because they are larger than the other walls, and they are the contact walls of the luggage in a stack of luggages. The extensions (37) and depressions (39) allow the novel luggage piece to mate and interlock with other similar pieces to provide a more stable stack of pieces, as in a hotel room or a stateroom. As shown in FIG. 6, the depressions (39A) in smaller, but similar piece of luggage (40) can rest on the extensions (37) of a larger piece. FIG. 6 illustrates also that the novel luggage can be provided in various sizes as is the case with prior luggage.

There are four, although there can be two, casters (41) attached to the outside surface of the shell back wall (25). The casters (41) permit the luggage to be rolled along a paved floor (not shown) if desired. The casters (41) may swivel, or not swivel, or some combination of the two.

The drawer (23) includes a front wall (43), a right side wall (45), a left side wall (47), a back wall (49) and a bottom wall (51). The margins of the front wall (43) overlap over the edges of the open end of the shell, and there is a marginal flange (53) along the margins of the front wall (43) that extends a short distance backwards and fits into the peripheral recess (35) in the shell (21) with a reasonably tight seal when the drawer (23) is slid to its closed position. If the luggage is left out in a rain storm, the contents will be protected from the rain, particularly if the luggage stands with the front wall (43) facing upwards. There is a handle (55) mounted in the center of the front wall (43) for manually carrying the novel luggage.

Figure 5:
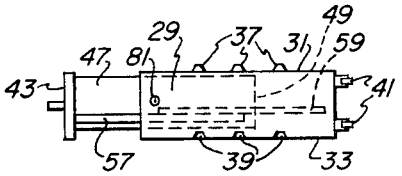
Figure 3:
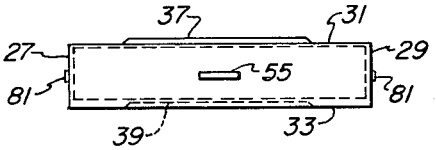
Figure 7:
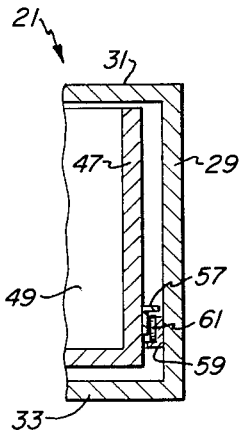
FIGS. 7, 8 and 9 are fragmentary front sectional elevational views of some novel luggages showing examples of a roller slide, a bar slide and a runner slide respectively, for the drawers thereof.

As shown in FIGS. 1, 5 and 7, the drawer (23) is slidably mounted on roller slides (57), which include a drawer track (57) attached to the outside surface of each drawer side wall (45) and (47), a shell track (59) attached to the inside surface of each shell sidewall (27) and (29), and a plurality of rollers (61) therebetween. The use of roller-type slides permits the drawer (23) to be substantially fully extended from the shell (21) when it is opened.

Figure 8:
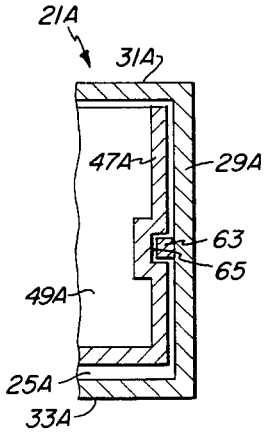
Figure 9:
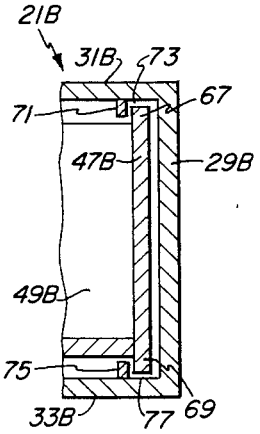

Other types of slides may be used particularly where it is desired to reduce the cost to fabricate the luggage, to reduce the weight of the luggage, and/or increase the volume capacity of the drawer (23). For example, as shown in FIG. 8, the left sidewall (29A) may have a left bar (63) attached to and extending along the inside surface thereof from the shell back wall (25A) forward. The drawer left sidewall (47A) has a groove (65) therein which slidably matches the shape of the bar (63). This luggage has a shell (21A), a top shell wall (31A), a bottom shell wall (33A), and a drawer back wall (49A). Although not shown, the right shell wall has a mirror-image structure with the left shell sidewall (29A), including a right bar attached to and extending along the inside surface thereof from the shell back wall (25A) forward. The drawer right sidewall has a groove therein which slidably matches the shape of the right bar. In another example, as shown in FIG. 9, the left drawer sidewall (47B) extends a short distance above and below the drawer back wall (49B) to provide an upper runner (67) and a lower runner (69). The inside of the shell top wall (31B) has upper runner guides (71) forming upper grooves (73) in which the upper runners (67) can slide. The inside of the shell bottom wall (33B) has lower runner guides (75) forming lower grooves (77) in which the lower runners (69) can slide. This luggage includes a shell (21B) and a left shell sidewall (29B). Although not shown, this luggage includes a right drawer sidewall which has a mirror-image structure with the left sidewall (29B). The right drawer sidewall extends a short distance above and below the drawer backwall (49B) to provide an upper runner and a lower runner which slide in an upper groove and a lower groove respectively.

The shell sidewalls (27) and (29) also include optional means (81) for locking the shell (21) to the drawer (23), at least for security purposes. The novel luggage must have at least a means for detachably latching the shell (21) to the drawer (23) so that the shell does not fall off when the luggage is lifted by the handle (55). Such a latching means preferably engages automatically. The latching means can be a leaf spring on the shell (21) which normally engages the drawer (23), and which can be depressed manually to detach and disengage it from the drawer (25). Alternatively, it can be a freely-rotating hook mounted on one (or both) shell sidewalls, which is disengaged when the front wall (43) of the drawer (23) faces sidewards, and which rotates by the force of gravity to engage a pin or eye on the inside shell sidewall(s) when the drawer front wall (43) is rotated to face upwards.

Figure 10:
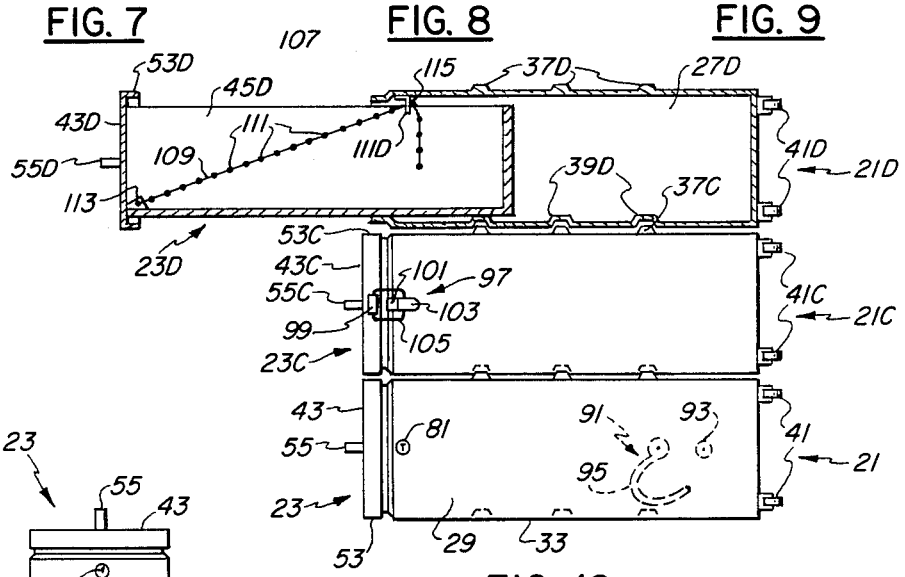
FIG. 10 is a partially-sectional, side elevational view of a stack of similar hand luggages stacked upon one another showing some additional optional features that can be incorporated into the novel hand luggage.
Figure 11:
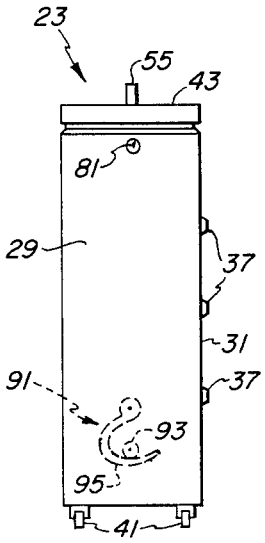
FIG. 11 is a side elevational view of the bottom luggage shown in FIG. 10 removed from the stack and rotated 90°, with the front wall of the drawer facing upwards.

FIG. 10 shows the luggage shown in FIG. 1 with two similar pieces of luggage stacked thereon. The middle luggage has a shell (21C) and a drawer (23C) with similar specific structures to those shown in FIG. 1, which are indicated with the same reference numerals followed by the letter "C". The top luggage has a shell (21D) and a drawer (23D) with similar specific structures to those shown in FIG. 1, which are indicated with the same reference numerals followed by the letter "D". The bottom luggage has a lock (81) and also two internal automatic latches (91). Each latch comprises a pin (93) on the outer sides of the drawer sidewall (45) and (47), and a freely-rotatable hook (5) on the inside shell sidewalls (27) and (29). When the luggage is lying, as shown in FIG. 10 with the drawer front wall (43) facing sidewards, the hook (95) is disengaged from the pin (93). When the luggage is removed from the stack and rotated 90° as shown in FIG. 11, the hook (95) is rotated by gravity so that the hook (95) engages the pin (93), thereby holding the shell (21) in a fixed relationship with the drawer 23.

FIG. 10 also shows a similar luggage comprising a shell (21C) and a drawer (23C) and having two external manual latches (97). Each of the manual latches (97) comprises a drawer bracket (99) attached to the outer surface of the drawer flange (53C), a shell bracket (101) attached to the outer surface of the shell sidewalls (27C) and (29C), a pull-down lever (103) hinged to the shell bracket (101), and a wire loop (105) rotatable in the pull-down lever (103) and engagable with the drawer bracket (99). With the drawer (23C) in its closed position, the pull-down lever (103) is raised, the loop (105) is engaged with the drawer bracket (99), and then the pull-down lever (103) is returned to its lowered position to latch the shell (21C) to the drawer (23C). To unlatch the shell (21C) from the drawer (23C), the foregoing steps are revised.

The top luggage of the stack shown in FIG. 10, shows the drawer (23D) more than half open in the shell (21D), and support means (107) to hold the drawer (23D) in a horizontal position. The support means (107) includes a metal chain (109) having a plurality of ball stops (111). One end of the chain (109) is anchored to the front of the drawer (23D) with a front bracket (113).

A back bracket (115) is attached to the front inside of the top wall (31D). The back bracket (115) has a slot into which the user can slide the ball stop (111D) that provides the proper length of chain (109) for holding the drawer horizontal.

With the drawer open, and under some loading conditions, the entire top hand luggage may tip; that is, the back of the shell (21D) will rise. It may be desirable to provide suitable anti-tipping means to prevent this; for example, a ledge may be molded into a adjacent shells and a metal leaf spring that can be provided to snap over these ledges and hold the adjacent shells together. An alternative can be means for hooking adjacent shells together; or one or more of the extensions (37C) in the adjacent shell (21C) can be made to press fit into the depressions (39D) of the top shell (21D).

As a further convenience, the drawer (23) may have a sheet or straps attached at one end to the inside of one of the drawer walls, and means for securing the other end(s) inside the drawer. This amenity can be used to hold the contents of the drawer in place while it is being transported. FIG. 6 shows one arrangement wherein a stretchable sheet (83) is held fixedly at one end (85) to the inside surface of the drawer back wall (49), and the other end (87) thereof can be hooked through holes therein to headed pins (89) in the inside of the drawer front wall (43). The contents of the drawer (23) can, thereby be held between the drawer bottom wall (33) and the sheet (83).

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. Hand luggage comprising a substantially rectangular shell including two opposed major walls and one open end; a single rectangular drawer slidably mounted in said shell on roller-type full-extension drawer slides; said drawer including a front wall having a marginal flange perpendicular to said front wall that overlaps and completely closes said open end of said shell when said drawer is slid to its closed position; said marginal flange including a portion that extends entirely around said shell; a carrying handle attached externally to said front wall, and orientation-sensitive means for detachably latching said shell to said drawer when said drawer is in said closed position.

2. The luggage defined in claim 1 including means for locking said shell to said drawer; and wherein said latching means comprises a freely rotatable hook mounted on the inside of said shell and engagable with a pin mounted on said drawer, said hook being disengaged from said pin when said major walls are horizontal and said hook is engaged with said pin when said major walls are substantially vertical.

3. The luggage defined in claim 1 including means attached inside said drawer for holding down items stored in said drawer; said holding-down means comprising a sheet of stretchable material, said sheet being fixedly attached at one end thereof to the inside of said drawer, and being detachably attachable at the other end thereof to attachment means inside said drawer.

* * * * *